US006755139B2

(12) United States Patent
Pannwitz et al.

(10) Patent No.: US 6,755,139 B2
(45) Date of Patent: Jun. 29, 2004

(54) BUTTONHOLE SEWING MACHINE

(75) Inventors: Frank Pannwitz, Hövelhof (DE); Rüdiger Mörbt, Bielefeld (DE); Werner Maasjost, Verl (DE); Thomas Nöltge, Bielefeld (DE)

(73) Assignee: Dürkopp Adler Aktiengesellschaft, Bielefeld (DE)

( * ) Notice: Subject to any disclaimer, the term of this patent is extended or adjusted under 35 U.S.C. 154(b) by 0 days.

(21) Appl. No.: 10/645,393

(22) Filed: Aug. 21, 2003

(65) Prior Publication Data

US 2004/0035342 A1 Feb. 26, 2004

(51) Int. Cl.[7] ..... D05B 3/08; D05B 21/00

(52) U.S. Cl. ..... 112/66; 112/68; 112/70; 112/470.04

(58) Field of Search ..... 112/66, 68, 65, 112/70, 73, 447, 475.25, 470.04; 700/136, 137, 138

(56) References Cited

U.S. PATENT DOCUMENTS 5,001,996 A * 3/1991 Tajima et al. ..... 112/103
6,220,192 B1 * 4/2001 Kahler et al. ..... 112/68
6,684,797 B2 * 2/2004 Noltge et al. ..... 112/66

FOREIGN PATENT DOCUMENTS

JP 2002-91558 3/2002
JP 2002-225245 8/2002

* cited by examiner

*Primary Examiner*—Peter Nerbun
(74) *Attorney, Agent, or Firm*—McGlew and Tuttle, P.C.

(57) ABSTRACT

A buttonhole sewing machine for producing buttonhole seams with seam end sections of various shapes in a work piece comprises an input equipment for feeding buttonhole parameters; and a computer for calculating, from the buttonhole parameters, sewing data that determine the respective buttonhole geometry. It further comprises a memory for storing the computed sewing data and a key to be shifted into two key statuses, by means of which to trigger conversion of a buttonhole seam from a position to the left to a position to the right or vice versa, and storage thereof.

8 Claims, 3 Drawing Sheets

BUTTONHOLE SEWING MACHINE

BACKGROUND OF THE INVENTION

1. Field of the Invention

The invention relates to a buttonhole sewing machine for producing in a work piece buttonhole seams with seam end sections of various shapes.

2. Background Art

In clothes such as coats, jackets, shirts etc. which are closed at the front by buttons and buttonholes, the menswear buttonholes are disposed in mirror-image arrangement as compared to ladies' wear buttonholes. In these buttonholes, the thread supplied by the needle to the sewing machine extends approximately in the form of a line on the externally visible side where the button comes to rest after buttoning.

In some clothes, for example in knitwear, the buttonholes run lengthwise in parallel to the edge of the work piece. The buttonholes are disposed one after the other in the longitudinal direction. They have seam end sections of varying shape i.e., stay stitching of various shapes such as round stays, wedge-shaped stays, zigzag stays or eye-type stays.

For buttonhole seams of this type to be sewn, U.S. Pat. No. 3,216,381 describes a buttonhole sewing machine of the generic type, comprising a base plate, a top arm and a standard that unites the base plate and the arm, and a needle bar which is lodged in the arm and provided with a needle and which reciprocates up and down, drivable substantially in a z direction by means of a main driving motor. Furthermore, this sewing machine comprises a work piece clamp which is displaceable in the y direction i.e., in the longitudinal direction of the machine, clamping the work piece. The standard stands back from a y-z plane that passes through the needle. This design enables a work piece to be placed with its buttonhole edge in parallel to the longitudinal direction of the arm i.e., in the longitudinal direction of the sewing machine, without being obstructed by the standard. Producing the buttonhole seams, mentioned at the outset, of mirror-image design depending on whether they are intended for ladies' wear or menswear will require a specific sewing machine in each case.

SUMMARY OF THE INVENTION

It is an object of the invention to embody a buttonhole sewing machine of the generic type in such a way that it can easily be reconverted, enabling mirror-inverted production of buttonholes of varying end sections.

According to the invention, this object is attained in a buttonhole sewing machine for producing buttonhole seams with seam end sections of various shapes in a work piece, comprising a base plate, a top arm and a standard that unites the base plate and the arm; a needle bar, which is housed in the arm and provided with a needle and which reciprocates up and down, drivable by a main driving motor substantially in a z direction; a table which is displaceable by a y driving motor in a y direction; a work piece clamp, which is disposed on the table, clamping the work piece on the table; a driving motor for producing a motion, in an x direction, of the needle relative to the work piece; a control system for controlling the driving motors, which an input equipment for buttonhole-parameter input is allocated to, which comprises a computer for computation, from the buttonhole parameters, of sewing data that determine a respective buttonhole geometry, which comprises a memory for storage of the computed sewing data, and which comprises a key to be shifted into two key statuses and by which to trigger conversion of the sewing data of a buttonhole seam from a position to the left into a position to the right or vice versa, and storage thereof. The buttonhole sewing machine according to the invention is embodied such that mirror-imaged or mirror-inverted buttonholes can be produced without any complicated program-input requirements. Placing the work piece in one direction or the other, as for example lapels to the left or to the right, enables the sewing data i.e., stitching coordinates, to be converted rather flexibly at the touch of a button as it were, The control system causes the driving motors and control units to be correspondingly triggered. Based on the measures according to the invention, the parameters that have been stored for a buttonhole can be used for a mirror-inverted buttonhole. Online calculation of the stitching coordinates takes place for the desired buttonhole. An available memory can be used for varying programs. Program conversion takes place rapidly and easily. Machine standstill is reduced. Simplicity of operation facilitates work. High operational reliability is accomplished because errors due to maloperation and faulty programming are strongly reduced.

Details of the invention will become apparent from the ensuing description of an exemplary embodiment, taken in conjunction with the drawing.

DESCRIPTION OF A PREFERRED EMBODIMENT

Figure 1:
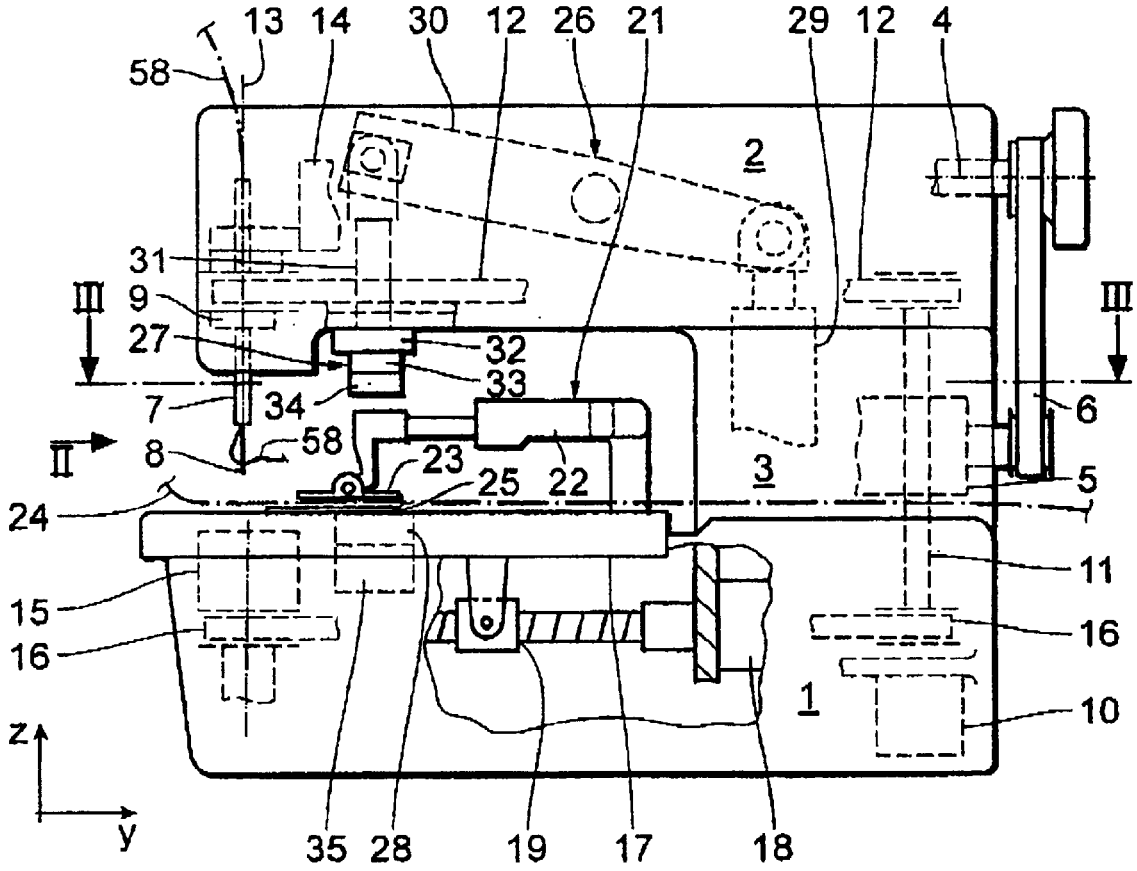
FIG. 1 is a side view of a buttonhole sewing machine.

The sewing machine seen in the drawing comprises a base plate 1 of the type of a housing, a top arm 2 and a vertical standard 3 that unites the two so that the sewing machine has an overall shape of a C. An arm shaft 4 is lodged in the arm 2, drivable via a belt drive 6 by a main driving motor 5 that is disposed in the standard 3. The arm 2 further houses a needle bar 7, the bottom end of which is provided with a needle 8. The needle bar 7 is conventionally drivable by way of the arm shaft 4 for up and down reciprocation substantially in the z direction. The needle bar 7 is mounted on a needle-bar-swivel and -jog bearing 9 which is drivable to rotate or jog about the central longitudinal axis 13 of the needle bar 7 by a swivel-bearing driving motor 10, disposed in the base plate 1, via a shaft 11, disposed in the standard 3, and a belt drive 12. Swivelling actuation of the bearing 9 takes place by an electric-motor swivelling and zigzagging drive 14.

A hook bearing 15 is customarily lodged for rotation in the base plate 1, cooperating with the needle 8 and drivable by the swivel-bearing driving motor 10 via a belt drive 16 synchronously and equiangularly of the bearing 9.

A table 17 in the form of an x-y table is disposed on the base plate 1 for displacement in the x and y direction; it is horizontally displaceable in the y direction i.e., in the longitudinal direction of the sewing machine, by means of a y driving motor 18, lodged in the base plate 1, via a spindle-nut drive 19. By means of an x driving motor 20, the table 17 is also horizontally displaceable, however crosswise of the y direction i.e., in the x direction. A design of this type is described in DE 102 33 017 A. A work piece clamp 21 is disposed on the table 17. It includes two clamping plates 23, 23' which are mounted on pivotable bearing levers 22, 22' and which are designed and arranged in mirror symmetry. By means of the clamping plates 23, 23', a work piece 24 is pressed on a bearing plate 25 that is mounted on the table 17. Details of design and actuation of such a work piece clamp 21 can be taken from U.S. patent application Ser. No. 10/410,466, U.S. Pat. No. 6,684,797, which reference is made to in this regard.

A buttonhole cutting device 26 is located downstream of the needle bar 7 seen in the y direction. It substantially comprises a drivable top cutter 27 and a bottom anvil 28. The top cutter 27 has a cutting drive 29 which is joined to a double-armed lever 30 which is again joined to a driving rod 31; the driving rod 31 is vertically displaceably guided in at least one guide bearing 32 that is mounted on the arm 2. Mounted on the bottom end of the driving rod 31 is a knife head 33, to the underside of which a knife 34 is replaceably attached. By means of a displacement drive 35, the anvil can be set into at least two positions underneath the knife 34 so that, depending on the position of the anvil 28, different cuts can be made. Further details of the buttonhole cutting device 26 will become apparent from DE 102 25 5 11 A, which is referred to in this regard.

Figure 3:
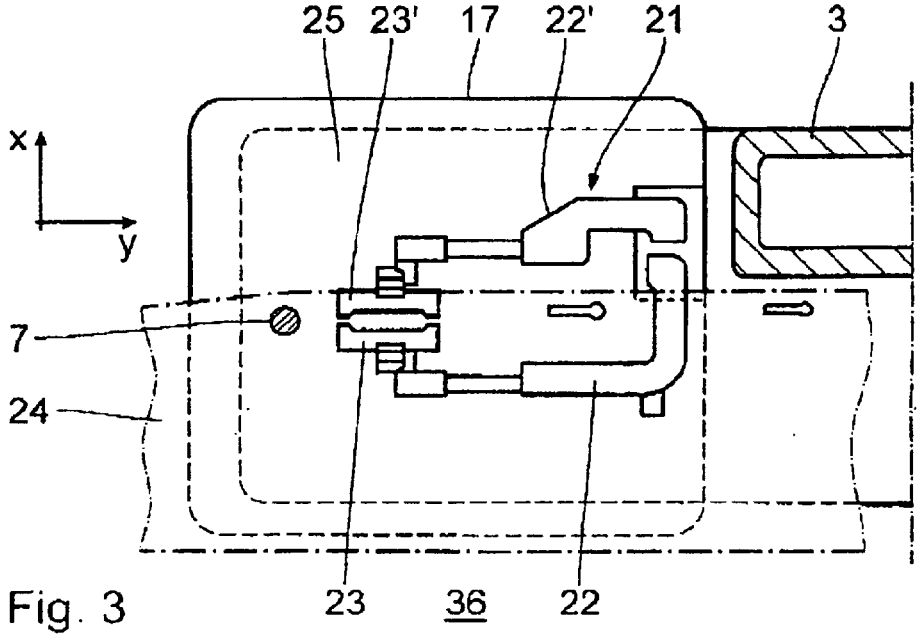
FIG. 3 is a partial horizontal section on the line III–III of FIG. 1.
Figure 2:
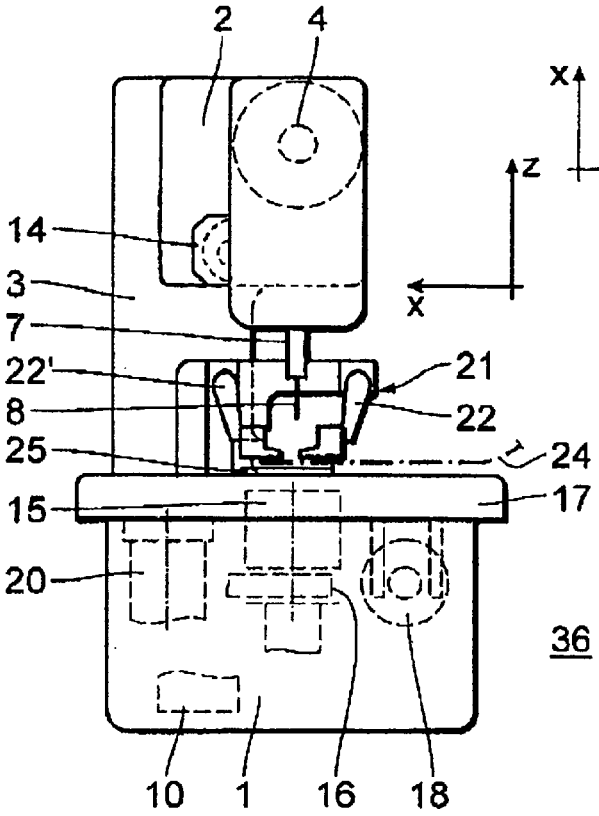
FIG. 2 is an elevation of the buttonhole sewing machine in accordance with the arrow 11 of FIG. 1.

As seen in FIGS. 2 and 3, the standard 3 is stands back, seen from the operator's side 36; seen in the x direction, it stands back from the y-z plane that passes through the needle bar 7. In this way it is possible, by means of the work piece clamp 21, to clamp work pieces 24 in the y direction on the table 17, the work pieces 24 reaching as far as the standard 3 and beyond, as roughly outlined in FIG. 3.

Figure 4:
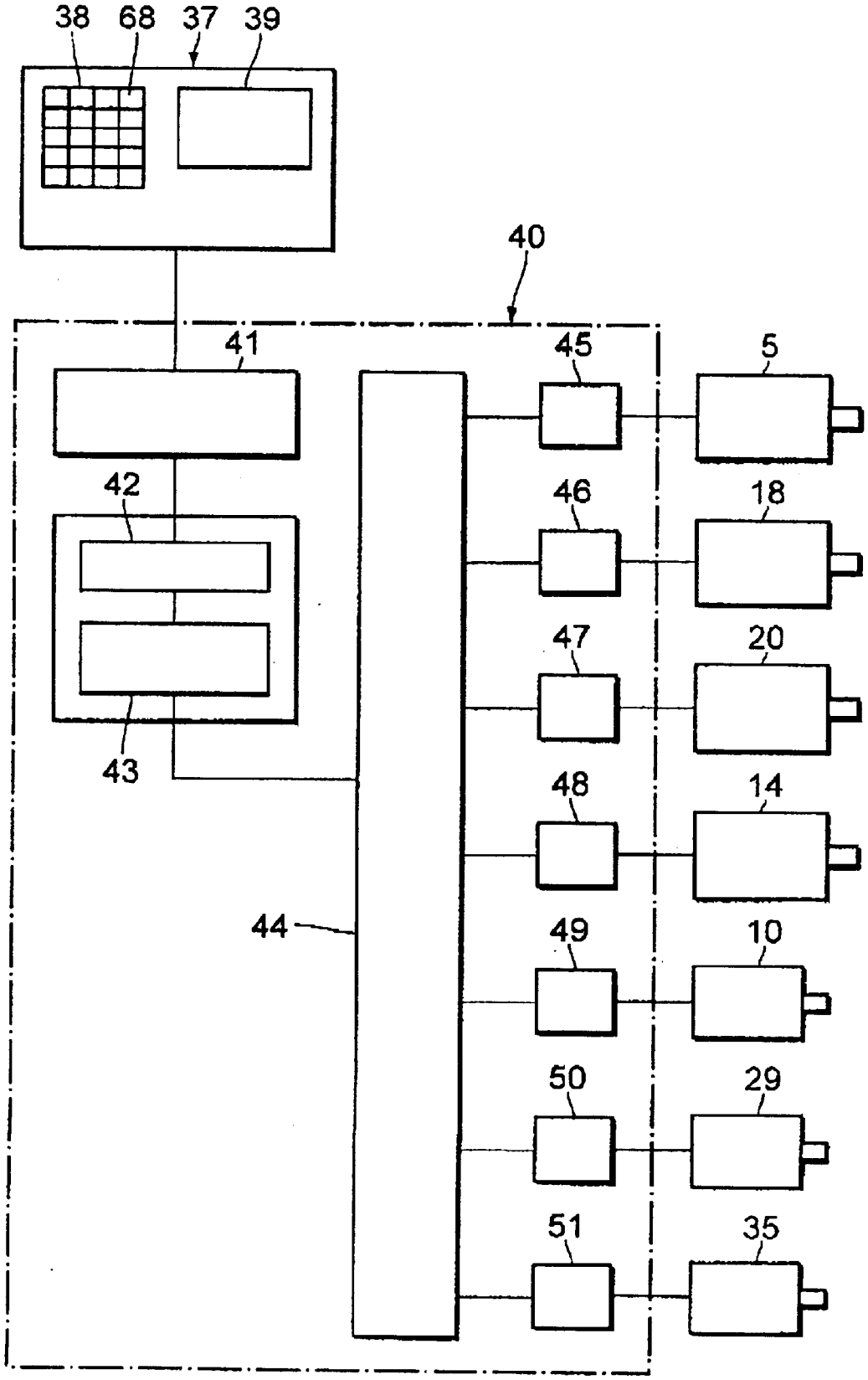
FIG. 4 is a diagrammatic illustration of the control system, the control desk and the driving motors of the sewing machine.

As seen in FIG. 4, the sewing machine comprises a control desk 37 provided with an input equipment 38 in the form of a keyboard and a display 39. Allocated to the control desk 37 is a control system 40 which includes a computer 41 and a first memory 42 for buttonhole parameters and a second memory 43 for sewing data. The computer, which is downstream of the control desk 37, and the memories 42 and 43, which are downstream of the computer, are connected, by an interface 44 and amplifiers (drivers) 45, 46, 47, 48, 49, 50, 51, to the main driving motor 5, the y driving motor 18, the x driving motor 20, the jogging and zigzagging motor 14, the swivel-bearing driving motor 10, the cutting drive 29 aid the displacement drive 35.

Figure 5:
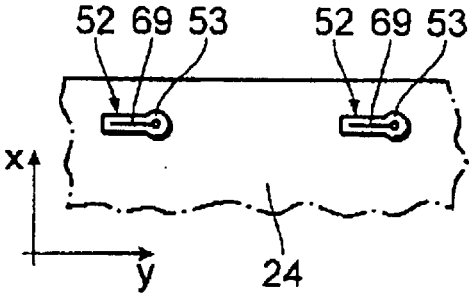
FIG. 5 is a view of a work piece with a row of buttonholes sewn in a first direction.
Figure 6:
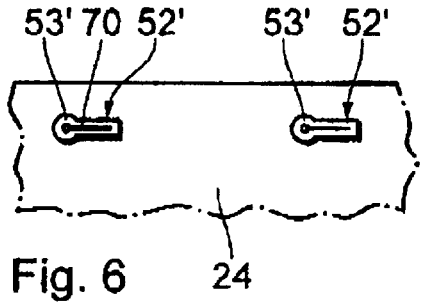
FIG. 6 is a view, corresponding to FIG. 5, of the work piece with buttonholes arranged in the opposite direction.
Figure 7:
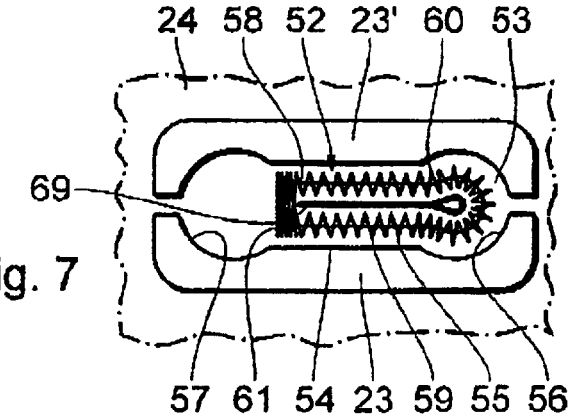
FIG. 7 is a view, on an enlarged scale, of an eye-type buttonhole with a zigzag stay.

The features specified enable varying buttonholes to be sewn without alterations in the y direction and in the reversed y direction. As seen in FIGS. 5 and 6, eye-type buttonhole seams 52 that run in the y direction can be produced in the work piece 24, with the eye-type seam end section 53 leading in the y direction. On the other hand, simple signaling (still to be described) at the control desk 37 will do to produce eye-type buttonhole seams 5' of the same kind with the eye-type seam end section 53' trailing in the y direction. Appropriate clamping plates 23, 23' are seen in FIG. 7. They define between them a rectangular area 54, straight in the y direction, where the straight seam section 55 of the buttonhole seam 52 is sewn. At both ends the rectangular area 54 terminates by an approximately circular area 56, 57, with the respective eye-type seam end section 53 or 53' being sewn in one of these areas. The area, opposite the eye-type seam end section 53 or 53', of the straight seam section 55, which is formed by the needle thread 58, a hook thread (not shown) and possibly a gimp thread (not shown) and which comprises two flat runs of zigzag stitches 59, 60, is provided with a zigzag stay 61 that is sewn in the rectangular area 54. If eye-type buttonhole seams 52' with a trailing eye-type seam end section 53' are to be sewn instead of the eye-type buttonhole seams 52 with eye-type seam end sections 53 that lead in the y direction, then the eye-type seam end section 53 is formed in the circular area 57 of the clamping plates 23, 23'. The zigzag stay 61 is then sewn in vicinity to the circular area 56. Producing the flat runs 59, 60 and the zigzag stay 61 is effected exclusively by corresponding use of the jogging or zigzagging motor 14 and the y driving motor 18. Producing the eye-type seam end section 53 is however effected by additional use of the swivel-bearing driving motor 10 and the x driving motor 20.

Figure 8:
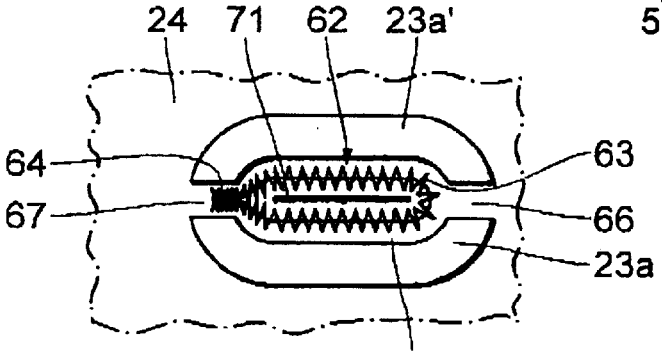
FIG. 8 is a view, on an enlarged scale, of a buttonhole with a round stay and wedge-shaped stay.

FIG. 8 illustrates that it is also possible to sew linen buttonhole seams 62 that have for example a round stay 63 at one end and a wedge-shaped stay 64 at the other end. In this case, the clamping plates 23*a* and 23*a'* are embodied to have an area 65 for placement, between them, of the buttonhole scam 62; and recesses 66, 67 at both ends for reception of a wedge-shaped stay 64.

Selection of the type of buttonhole seam 52, 62 and the position thereof takes place at the input equipment 38, with the seam of an eye-type buttonhole or of a so-called linen buttonhole being conceivable. Fundamentally, this involves buttonhole seams 52, 62 of varying end sections, for example with an eye-type seam end section 53 or a stay such as a round stay 63, wedge-shaped stay 64, zigzag stay 61 or the like.

Depending on the type and position of buttonhole seam selected, pictorial representation takes place on the display 39. Then buttonhole parameters are fed the input equipment 38, which are deposited in the first memory 42. Based on these buttonhole parameters, the computer 41 calculates the actual sewing data such as the stitch coordinates and the number of stitches of the individual seam sections and the like.

These sewing data that determine the geometry of a seam are recorded in the second memory 43. When such a buttonhole seam is to be sewn, these data are read out the second memory 43, via the amplifiers 45 to 51 triggering the various drives 5, 18, 20, 14, 10, 29, 35.

When, by way of a given key 68 of the input equipment 38, a reversed position of a buttonhole is called, the sewing data of which have been stored, conversion of the sewing data available in the computer 41 is automatically triggered, the converted data being recorded, and correspondingly available, in the second memory 43. The sewing data are automatically mirrored, as it were, depending on whether a position of the buttonhole to the right or to the left is called. In the process, the position of the buttonhole shows on the display 38.

When the respective buttonhole seam has been sewn, the anvil 28 is moved by the displacement drive 35 into a position allocated to the corresponding cut 69, 70, 71 and then the cutting drive 29 is triggered.

What is claimed is:

1. A buttonhole sewing machine for producing buttonhole seams with seam end sections of various shapes in a work piece (24), comprising a base plate (1), a top arm (2) and a standard (3) that unites the base plate (1) and the arm (2);

a needle bar (7), which is housed in the arm (2) and provided with a needle (8) and which reciprocates up and down, drivable by a main driving motor (5) substantially in a z direction;

a table (17), which is displaceable by a y driving motor (18) in a y direction;

a work piece clamp (21), which is disposed on the table (17), clamping the work piece (24) on the table (17);

a driving motor (14, 20) for producing a motion, in an x direction, of the needle (8) relative to the work piece (24);

a control system (40) for controlling the driving motors (5, 14, 18), which an input equipment (38) for buttonhole-parameter input is allocated to, which comprises a computer (41) for computation, from the buttonhole parameters, of sewing data that determine a respective buttonhole geometry, which comprises a memory (43) for storage of the computed sewing data, and which comprises a key (68) to be shifted into two key statuses and by which to trigger conversion of the sewing data of a buttonhole seam from a position to the left into a position to the right or vice versa, and storage thereof.

2. A buttonhole sewing machine according to claim 1, wherein a display (39) is provided, emitting information in accordance with a selected buttonhole position.

3. A buttonhole sewing machine according to claim 2, wherein the display (39) is configured for displaying a buttonhole picture.

4. A buttonhole sewing machine according to claim 1, wherein the standard (3) stands back from a y-z plane that passes through the needle bar (7).

5. A buttonhole sewing machine according to claim 1, wherein the needle bar (7) is mounted on a needle-bar-swivel and -jog bearing (9) and drivable for rotation about a central longitudinal axis (13) by a swivel-bearing driving motor (10); and wherein the swivel-bearing driving motor (10) is triggered by the control system (40).

6. A buttonhole sewing machine according to claim 1, wherein the table (17) is drivable by an x driving motor (20) in the x direction; and wherein the x driving motor (20) is triggered by the control system (40).

7. A buttonhole sewing machine according to claim 1, wherein a buttonhole cutting device (26) is provided, the cutting drive (29) of which is triggered by the control system (40).

8. A buttonhole sewing machine according to claim 7, wherein the buttonhole cutting device (26) has an anvil (28), which is displaceable into at least two different positions relative to a knife (34) by a displacement drive (35); and wherein the displacement drive (35) is triggered by the control system (40).

* * * * *

UNITED STATES PATENT AND TRADEMARK OFFICE

CERTIFICATE OF CORRECTION

PATENT NO. : 6,755,139 B2
DATED : June 29, 2004
INVENTOR(S) : Pannwitz et al.

It is certified that error appears in the above-identified patent and that said Letters Patent is hereby corrected as shown below:

Title page,
Insert Item:

-- [30] Foreign Application Priority Data

Aug. 23, 2002 (DE)…….. 102 38 708.7 --

Signed and Sealed this

Seventh Day of December, 2004

JON W. DUDAS
*Director of the United States Patent and Trademark Office*